United States Patent [19]

Saunders et al.

[11] 4,036,539

[45] July 19, 1977

[54] DRILL STRING SYSTEM

[76] Inventors: Leonard R. Saunders, 2522 Watts Road, Houston, Tex. 77025; G. D. Skip Allard, 14602 Dale Hollow Lane, Cypress, Tex. 77429

[21] Appl. No.: 576,030

[22] Filed: May 9, 1975

[51] Int. Cl.[2] ..... F16C 1/26

[52] U.S. Cl. ..... 308/4 A; 166/241; 175/325

[58] Field of Search ..... 308/4 R, 4 A; 166/301, 166/241; 175/325; 161/216

[56] References Cited

U.S. PATENT DOCUMENTS

| | | | |
|---|---|---|---|
| 3,420,323 | 1/1969 | Owens | 175/323 |
| 3,468,753 | 9/1969 | Vincent et al. | 161/216 |
| 3,616,190 | 10/1971 | Shaw | 161/216 |
| 3,916,998 | 11/1975 | Bass et al. | 308/4 A X |
| 3,948,575 | 4/1976 | Rosser | 308/4 A |

OTHER PUBLICATIONS

Crandalon by Xenex Corporation.

Report on Crandalon Panels Submerged in Oyster Creek Waretown, New Jersey by R. Turner June 18, 1973.

*Primary Examiner*—Joseph F. Peters, Jr.

*Assistant Examiner*—Gene A. Church

*Attorney, Agent, or Firm*—Cushman, Darby & Cushman

[57] ABSTRACT

A drill string system, having a greatly reduced tendency for balling and sticking in oil field clay or sticky shale, is provided on its non-bearing surfaces, with an adherent plastic covering, e.g. a polyurethane polymer. The plastic coating is applied to the non-bearing steel surfaces of the string, which have been cleaned of rust and have been coated with a primer.

11 Claims, 9 Drawing Figures

DRILL STRING SYSTEM

BACKGROUND OF THE INVENTION

This invention relates to well drilling operations and more particularly to improved drill string systems, to increase drilling efficiency.

The device of the instant invention provides decided advantages, as a component of the drill pipe string. The problem often encountered, in well drilling operations, and when using known types of stabilizers, is the sticking or balling of the drill string within the bore or casing due to build-up of drill cuttings, mud, cement, and/or the like, about the stabilizer blades. The stabilizers, include a pipe-like body, having outwardly extending blades, said blades having outwardly facing bearing surfaces. The bearing surfaces of the blades constitute the outermost surfaces on the stabilizer and have a diameter slightly less than the casing and normally the same diameter of the bore hole. The bearing surfaces of the blades will be the first part of the string to contact the casing or bore hole wall to stabilize the drill string.

The invention is directed to improvements in ordinary stabilizers. Ordinary stabilizers tend to carry a build-up of mud, drill cuttings, and the like, between the blades during the drilling operation. This build-up of mud, referred to as "balling", clogs the bore hole against drilling fluid flow and also can cause the stabilizer to become stuck thus freezing the drill string. Under these circumstances, the string cannot be removed from the casing or bore hole wall. Under other balling conditions the drill string can act as a plunger, which can lead to serious results, if the stabilizers become balled in a gas field. Particularly, when the string becomes balled in a gas field, swabbing can result in a blow-out. The invention seeks to provide elimination of balling and to reduce the possibility of blow-outs, sticking and to increase drilling efficiency.

SUMMARY OF THE INVENTION

In accordance with the invention, there is provided an improved string assembly and improved stabilizer which may be employed in down hole operations under conditions which might result in material build-up around the stabilizer blades, by providing non-bearing parts of the string, and non-bearing parts of the stabilizer, with an adherent plastic coating, which is characterized by a low coefficient of friction, abrasive resistance, low surface tension, durability, toughness, and slickness. A polyurethane polymer is highly preferred, as the material for this coating, although it is believed that certain acrylic resins and certain epoxy resins may be used.

The coating of the non-bearing string assembly, and in particular coating on the non-bearing surfaces of the stabilizer, obviates build-up of materials between the stabilizer blades as a result of scraping or reaming action of the blades. By coating the surface of ordinary stabilizers, in accordance with the invention, it has been discovered that drilling speeds and drilling efficiency was increased significantly before balling resulted.

DESCRIPTION OF THE DRAWINGS

The instant invention will be more particularly understood by reference to the Figures of the drawing which illustrate the instant invention, as to specific embodiments:

FIG. 3 is a side elevation, partly in section, of a blade stabilizer, while

In FIGS. 1 through 8, the letters *a* and *b* refer to the non-coated and to the coated, respectively, surfaces of strings, stabilizers and bits, in accordance with the invention. The letter *a* is used to designate surfaces which are not coated in accordance with the invention and hereinafter are referred to as bearing surfaces. The letter *b* is used to refer to surfaces which are coated in accordance with the invention.

Figure 1:
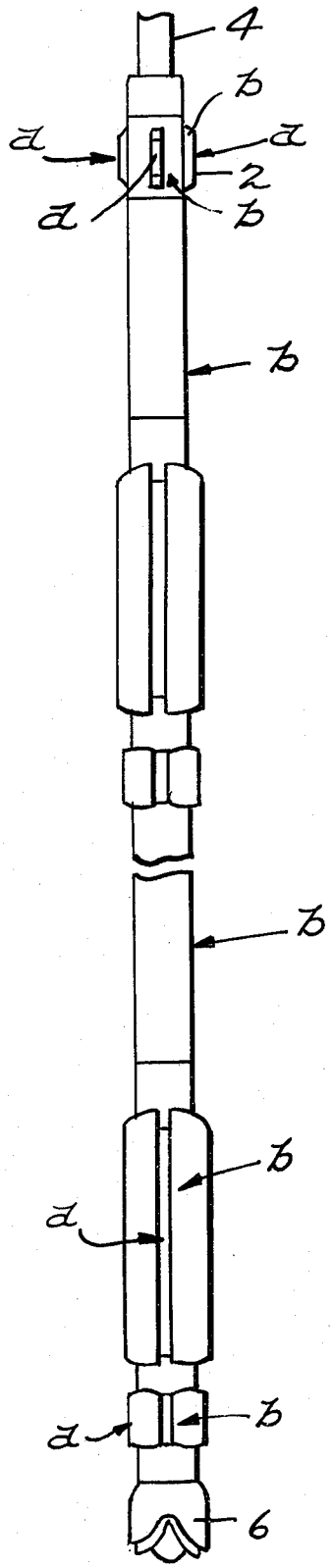
FIG. 1 and FIG. 2 are side elevations of schematic representations of typical bottom hole assemblies. However, the invention is meant to be inclusive of all bottom hole assemblies.
Figure 2:
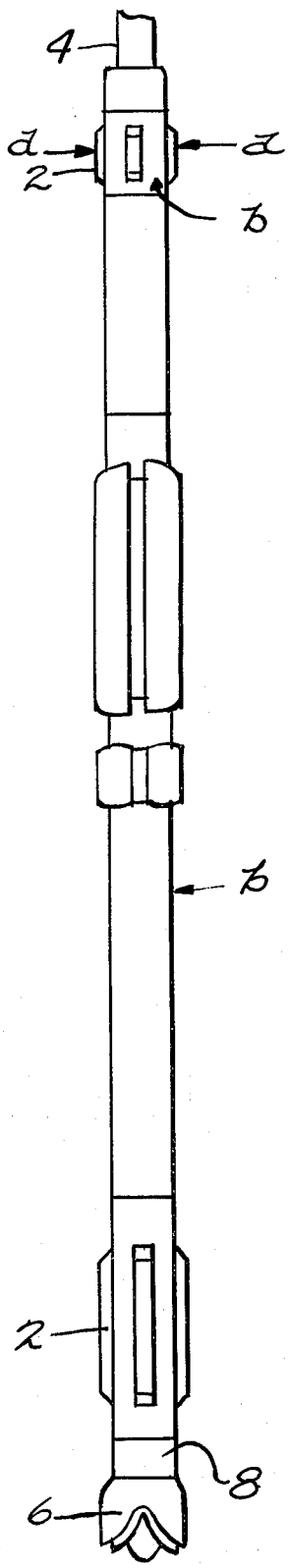
Figure 3:
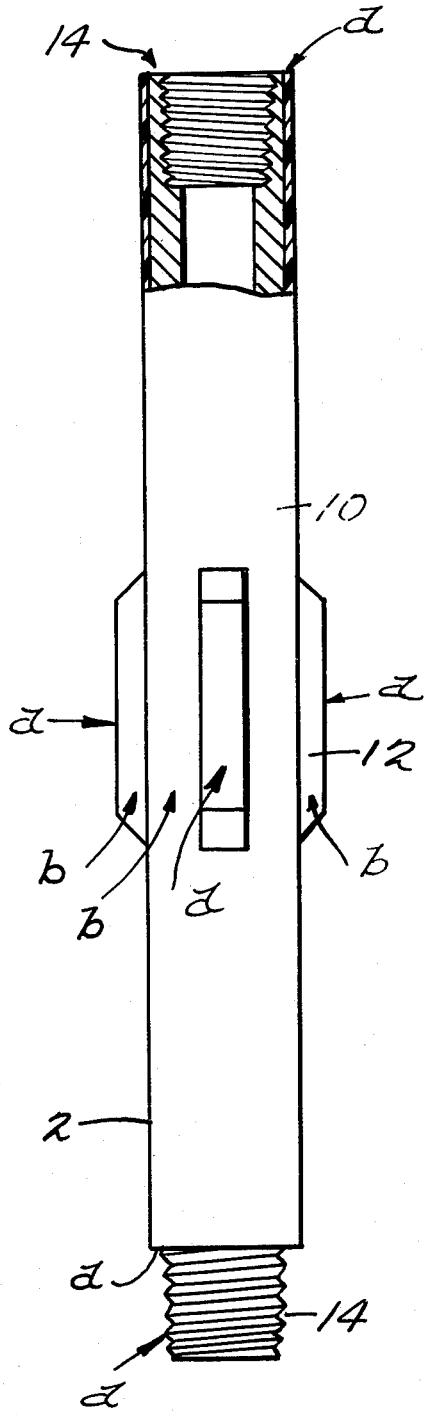
Figure 4:
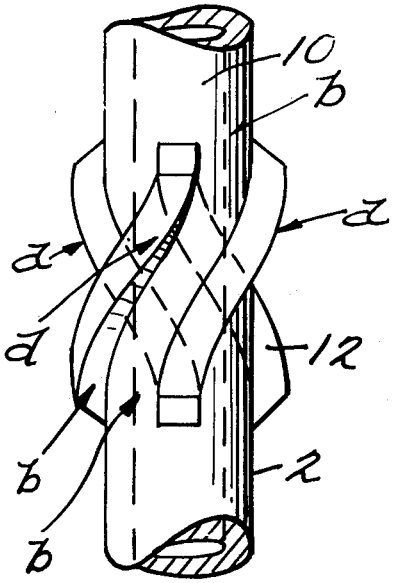
FIG. 4 is a side elevation, partly in section, of an alternative embodiment of a stabilizer used in accordance with the invention with portions broken away for clarity.
Figure 6:
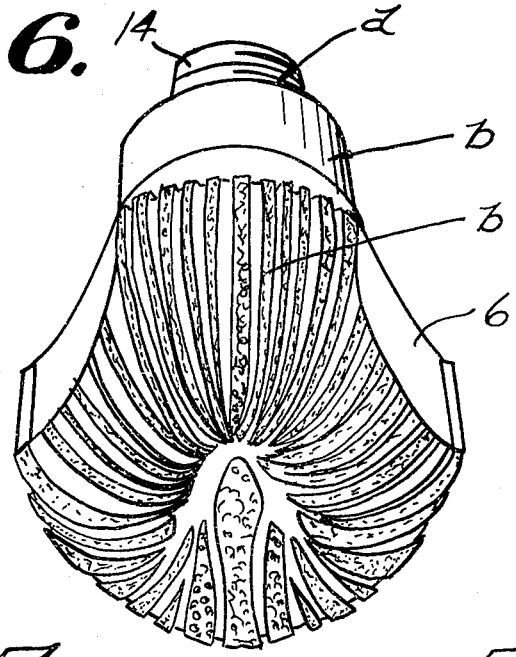
FIGS. 6 and 7 present alternative forms of embodiments of the bit which may be used in accordance with the invention, although these embodiments are not to be considered limiting. FIG. *7a* is a bottom plan view of the bit of FIG. 7.
Figure 7:
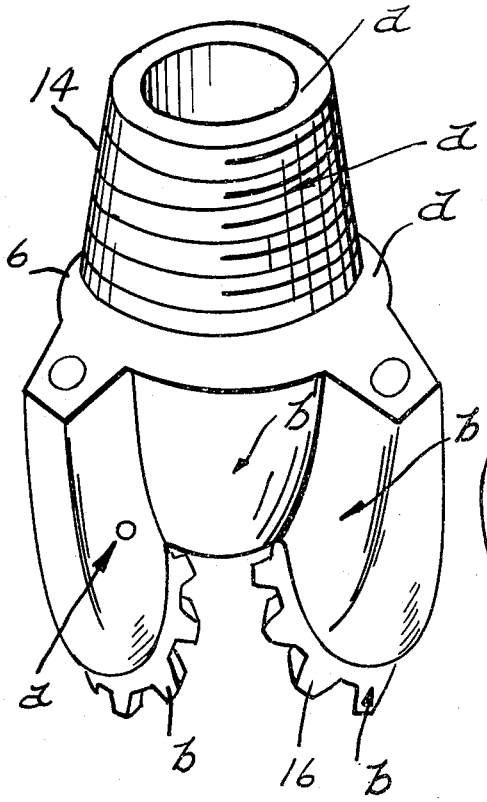
Figure 7A:
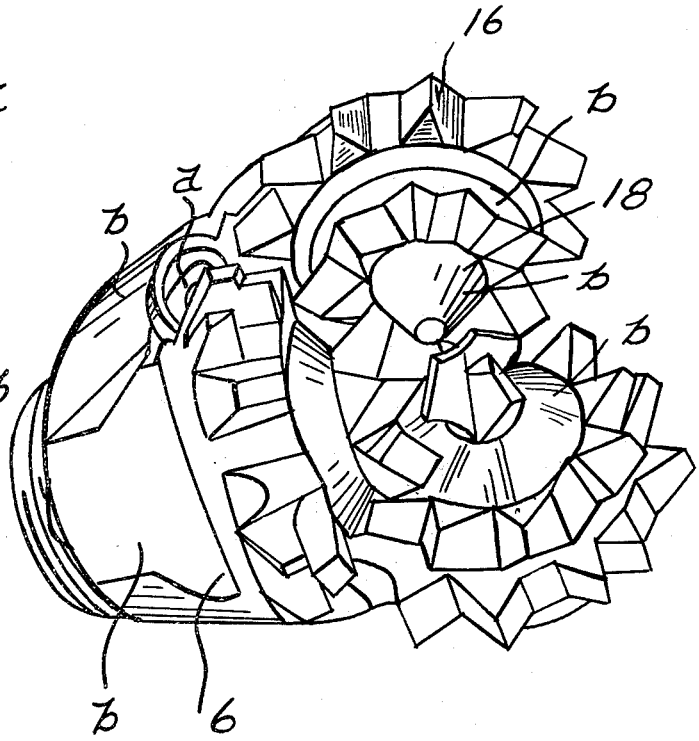

In the drawings, 2 is a stabilizer. While four blade-stabilizers are shown, we generally employ stabilizers with three blades. 4 refers to the heavy-weight drill pipe. 6 is a bit, different embodiments of which are set forth in FIGS. 1, 2, 6, and 7. 8 is a bit sub. The dotted line in FIG. 2 identified as 8 indicates the position in which a bit sub would be located, when not used in conjunction with a near bit stabilizer. 10 refers to the body of the stabilizer, while 12 indicates the blades on a stabilizer. The number 14 is used to refer to thread and shoulder surfaces, which are used to engage members of a string to form the complete string and which are not to be coated in accordance with the invention. While the bit of FIG. 6 is a diamond drill bit, the drill of FIG. 7 is a steel tooth bit. 16 refers to teeth on the tooth bit, while 18 refers to a cone of the tooth bit.

DETAILED DESCRIPTION OF THE INVENTION

In accordance with the invention, non-bearing surfaces of a drill string can be coated with an adherent polymer coating in order to provide a slick surface during the drilling operation and to lengthen the duration of the period during which drilling may be undertaken, prior to balling, by debris between the stabilizer blades during drilling and to other components of the drill string.

In particular, it has been discovered that a hard slick adherent coating on the stabilizer, between the fins or blades of the stabilizer, but not on the outside surfaces of the blades, will greatly decrease the tendency of balling between the stabilizer blades. The invention is not directed to a non-adherent coating, for instance a sleeve for the non-bearing surfaces of a stabilizer, a disclosed in U.S. Pat. No. 3,420,323. Rather, the coating of the invention is an adherent slick coating, which is abrasion-resistant.

In the preferred embodiment of the process, the stabilizer surface is rendered rust-free and grease-free, and then provided with a polyurethane coating.

The preferred coating is a solventless polyurethane system. That is, in a preferred embodiment, a pre-polymer polyurethane is used; preferably the pre-polymer is admixed with a catalyst and applied to the surface of the stabilizer and cured at ambient conditions. The preferred pre-polymer coatings are two-component polyurethane systems. By two-component system, is meant a component A which contains the pre-polymer urethane containing free NCO groups, and/or free hydroxy groups, while a second component B, which may be a diol or polyol, isocyanate (diisocyanate) or an amine, is for curing the pre-polymer formulation. Exact curing conditions vary depending on the nature of the component A and B. Moisture cure, reaction of the pre-polymer with curing agents and elevated temperatures may be used alternatively or conjunctively as curing conditions. Thermosetting of the pre-polymer is undertaken by cross-linking and branching of the main chain or backbone of the pre-polymer, while thermoplastic elastomers are produced by the use of straight chain diols and polyols, in the pre-polymer, with cures being effected by low-functionality amines. By pre-polymer urethanes is meant polymers of low molecular weight which contain free NCO groups (or hydroxy groups) which may further react with hydroxy functions, amine functions and isocyanates (diisocyanates). Generally, the pre-polymer is based on TDI (toluene diisocyanates), MDI (methylene diisocyanates) and CHDI (cyclohexylene diisocyanate).

In order to form the pre-polymer, these diisocyanates are reacted with hydrogen donors. Hydrogen donors, known in the art, include any compound having an active hydrogen, such as hydroxyl-terminated epoxies, hydroxyl-terminated polyesters, hydroxyl-terminated furanes, diols, polyols, amines, urethanes, disubstituted ureas, and compounds containing sulfhydryl, imino, substituted amino, carbonamide, substituted carbonamides, sulfonamides, substituted sulfonamides, thioamides and sulfonic groups. The more latently reactive hydrogens will need catalysts, of either the metallic soap or the highly active amine variety, in order to cleave the bond between the hydrogen and its associated molecule, for reaction of the active hydrogen. The two-component polyurethane systems, used in accordance with the invention, are preferably solventless polyurethanes. Although solventless polyurethanes are preferred, it is contemplated that solventless acrylic polymers and solventless epoxy polymers may also be used in accordance with the invention to produce epoxide coatings and acrylic coatings.

In order to coat steel surfaces with polyurethanes, it is usually advantageous to coat the steel surface with a primer, prior to applying the polyurethane. Prior to applying the primer to the steel surface, it is advantageous that the steel surface be grease-free and rust-free. Removal of rust and grease is preferably accomplished by sandblasting of the steel surface to be coated with primer, and subsequently with the polyurethane pre-polymer.

Primers for steel surfaces which are particularly receptive to bonding with polyurethane coatings include epoxy resins and acrylic resins.

Thus, in accordance with the preferred embodiment of the invention, improved stabilizer comprises the stabilizer, a primer coating over the non-bearing surface of the stabilizer, and a second coating over the primer comprising a polyurethane.

PREFERRED EMBODIMENTS OF INVENTION

To produce the improved stabilizer of the invention, an ordinary stabilizer is sandblasted. Sandblasting removes grease and rust from the surfaces. A primer P-222, sold by Xenex Corporation (Houston, Tex.) is applied to the rust-free non-bearing steel surface of the stabilizer. The primer coat is allowed to season for 12 hours. Alternatively, the Xenex Corporation primer Zebron™ Primer 626 may be employed after sandblasting the stabilizer. After sandblasting, the stabilizer is washed with solvent, the Zebron Primer-No. 626 is prepared for application. This primer should be applied by an air break-up spray gun at a medium range of 60 to 90 p.s.i. By preparation of Zebron Primer-No. 626 is meant the actual on site formation of the primer: The primer is sold as three components which are admixed consecutively with 40-minute periods of aging between the two mixing steps. After application a cure time of at least three hours should be allowed. Thereafter, a solventless polyurethane, preferably Zebron 98-477, provided by Xenex Corporation is admixed with a catalyzer (sold with Zebron 98-477, as catalyst 98-900) and is applied to the non-bearing surfaces of the stabilizer. The polyurethane coat may vary between 20 to 60 mils per coat. Application of the pre-polymer polyurethane was undertakene by employing a paint brush. However, the product Zebron may be applied by an airless hydraulic spray gun or by trowel.

After application of the first coat of polyurethane, the coat was allowed to dry and cure for 6 hours at ambient temperature and conditions. A second coat of solventless polyurethane (Zebron, Xenex Corportion) was applied to the dried and cured polyurethane subcoat. The second coat was allowed to dry and cure at ambient conditions for 6 hours. A third coat was applied in a similar manner. The fourth coat was applied to the surface and allowed to dry and cure for 7 days at ambient temperature and atmospheric conditions. The resulting coat is a thermoset coating.

IR spectra of the Zebron 98-477 showed the following characteristic absorption wavelengths.

| | | |
|---|---|---|
| 3380 – 3480 | $cm_{-1}$ | –OH & NH stretch |
| 1750 | $cm_{-1}$ | C = O stretch |
| 1620 | $cm_{-1}$ | NH bend |
| 1150 | $cm_{-1}$ | C – N stretch |
| 2900 | $cm_{-1}$ | aliphatic (straight chain absorption due to polymerization) |

An IR spectrum of the catalyzer 98-900 strongly suggested that it was an aromatic diisocyanate in view of the strong band at 2250 $cm^{-1}$ indicating an N = C = O bond. The spectrum resembled a reference spectrum of toluene 2,4-diisocyanate. Subsequently, a differential endotherm was run on the catalyzer sample. Endotherms were seen at 177° C and at 257° C. The first endotherm would indicate an impurity, such as a solvent, used to lower the melting point of the sample. The boiling point of pure toluene-2,4 diisocyanate is 251° C. Pure toluene 2,4-diisocyanate contains 16.08% nitrogen by weight. Experimental nitrogen content of the sample was 10.28% nitrogen. This indicates a purity (based on toluene 2,4-diisocyanate) of 63.93% pure. This further determination was further corroborated by unidentified spectral bands (IR) at 1750 $cm^{-1}$ and an organic chloride concentration of 0.141%.

It is not believed that four coats of polyurethane is essential. What is esential is that the polyurethane layer is of relatively uniform thickness. Obviously, an ultimate polyurethane coating on the stabilizer may be up to 500 mils thick. The only limitation is that too thick a coat of polyurethane coating may destroy the efficiency of the blades and interfere with mud flow in the drilling process. On application of four coats of a polyurethane, as above, the ultimate polyurethane layer was between 60 and 100 mils thick.

It was discovered that stabilizers, so coated, could be employed to substantially eliminate stabilizer balling.

A test employing coated stabilizers covered a test interval of 2048 feet. Four uncoated bits were required for this interval. A bit trip was made after 638 feet but no balling occurred. The second bit run, proved more conclusive when after 709 feet the bit balled and prevented drilling ahead. The drill string was pulled and balling had occurred on the heavy weight drill pipe, the bit sub and the bit, however the two coated stabilizers were clean and the coating still intact. The third bit run had similar results when bit balling occurred after 1291 feet. The fourth bit used completed the well after drilling 48 feet with no signs of any balling. The results of this test indicated that the coating was extremely abrasive resistant, eliminated stabilizer balling and should be used on other components of the drill string.

The durability of the coating was evident when observing the stabilizers used in this test. The coating was not fractured or did not peel where the rotary tong dies bit when making the stabilizers up. Because of the extreme abrasive resistance of the coating, employing it on components of the drill string can add to life of them.

Figure 5:
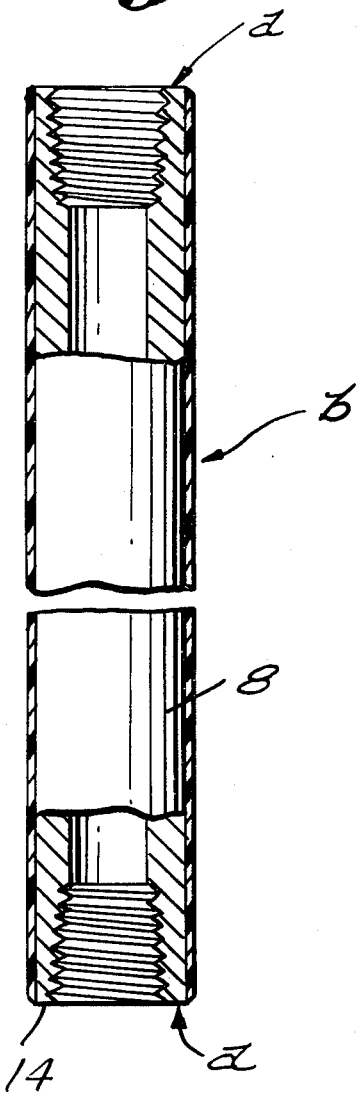
FIG. 5 is a side elevation, partly in section of a Bit-Sub, which is the first element above the bit in a string, when near bit stabilization is not used.
Figure 8:
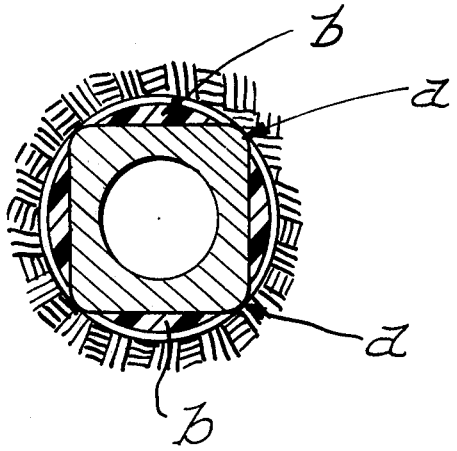
FIG. 8 presents a cross-section of a square drill collar, which may be used in accordance with the invention.

It is proposed that the efficiency of the drilling process may profit from coating in addition to the stabilizer, in accordance with the invention, all non-bearing surfaces of the string used in the drilling operation. By this statement, is meant to include the non-bearing surfaces of bits, bit subs, float subs, near bit stabilizers, down hole drilling motors, drill collars (steel monel & spiral), string stabilizers (integral blade, modified and regular), square drill collars, triangular drill collars, *x*-over subs, drill pipe (bodies and upsets), heavy weight drill pipe (tool joints, integral upsets, and bodies), string reamers, drilling jars, under reamers, and hole openers. By non-bearing surfaces, we mean all surfaces that are not full gauge to the bit. By "full gauge" we mean the same diameter of the bit and bore hole. In addition, by non-bearing surfaces, is meant, the surfaces of individual parts of the string, which engage, when the parts of the string are engaged to form the whole drill string. In this latter instance, by non-bearing surfaces, can be more easily understood by reference to the FIG. 5, wherein it is indicated that bit-sub is not coated at the fitting ends, by the number 14.

Thus, there has been provided an improved drill string assembly, which may be used for longer times than the unimproved string assemblies of the prior art, in drilling operations, before balling interferes with the drilling operation. The disclosure herein is not be meant as limiting, but rather the specific embodiments set forth are meant to include all alternatives and equivalents known in the art.

What is claimed is

1. In a drill string, including a metallic tubular body having wear-resistant bearing surfaces extending outwardly from said body, the improvement in combination with said drill string, comprising a coating of hard, slick adherent plastic on the non-bearing surfaces of said string, to reduce material build-up between the non-bearing surfaces during drilling.

2. The drill string of claim 1, wherein a coat of primer is disposed on said non-bearing surface of said string and between said string and said plastic coating.

3. The drill string of claim 2, wherein said plastic is a polyurethane, an epoxy resin, or an acrylic resin, which are formed from solventless polyurethanes, solventless epoxides, and solventless acrylic materials.

4. The drill string of claim 2, wherein said plastic is a thermoset polyurethane.

5. In a stabilizer, for interconnection in a drill string, wherein said stabilizer includes a metallic tubular body portion having a plurality of blades with outwardly facing wear-resistant bearing surfaces extending outwardly from said body, the improvement in combination with said stabilizer comprising a coating of a hard, slick adherent plastic on the non-bearing surfaces between said blades to prevent material build-up around said blades during drilling operations.

6. The stabilizer of claim 5, wherein said plastic is polyurethane.

7. The stabilizer of claim 6, including a layer of primer adhered to said non-bearing surfaces and disposed between said non-bearing surfaces and said adherent polyurethane.

8. A drill stabilizer for interconnection in a drill string which comprises: a central tubular member, having two tubular ends, and a plurality of blades having outwardly facing bearing surfaces extending outwardly from said central tubular member, and a coating of a hard, slick adhering plastic, on the non-bearing surfaces, disposed between said blades.

9. The stabilizer of claim 8, wherein said coating is flush with the bearing surfaces of said two ends.

10. The stabilizer of claim 8, wherein said blades are curved and extend helically around said central tubular member.

11. The stabilizer of claim 10, wherein the plastic is a thermoset polyurethane.

* * * * *